US010060115B2

(12) United States Patent
Miller et al.

(10) Patent No.: US 10,060,115 B2
(45) Date of Patent: Aug. 28, 2018

(54) TOILET FASTENING SYSTEM

(71) Applicants: Jody D. Miller, Indianapolis, IN (US); Darrell Wayne Bowden, Sheridan, IN (US); Anthony Joseph Parker, Wilkinson, IN (US)

(72) Inventors: Jody D. Miller, Indianapolis, IN (US); Darrell Wayne Bowden, Sheridan, IN (US); Anthony Joseph Parker, Wilkinson, IN (US)

(73) Assignee: AIIM, LLC, Indianapolis, IN (US)

( * ) Notice: Subject to any disclaimer, the term of this patent is extended or adjusted under 35 U.S.C. 154(b) by 8 days.

(21) Appl. No.: 15/723,683

(22) Filed: Oct. 3, 2017

(65) Prior Publication Data

US 2018/0023277 A1 Jan. 25, 2018

Related U.S. Application Data

(63) Continuation-in-part of application No. 14/826,672, filed on Aug. 14, 2015, which is a continuation of application No. 14/242,470, filed on Apr. 1, 2014.

(51) Int. Cl.
*E03D 11/16* (2006.01)
*E03D 11/17* (2006.01)

(52) U.S. Cl.
CPC ..... *E03D 11/17* (2013.01)

(58) Field of Classification Search
CPC ..... E03D 11/17
USPC ..... 4/252.4, 252.1
See application file for complete search history.

(56) References Cited

U.S. PATENT DOCUMENTS

| | | | | |
|---|---|---|---|---|
| 3,339,215 A * | 9/1967 | Flood | E03D 11/16 | 285/4 |
| 3,669,171 A * | 6/1972 | Yavitch | E03D 11/16 | 285/58 |
| 5,185,890 A * | 2/1993 | Dismore | E03D 11/16 | 4/252.1 |
| 7,658,580 B1 * | 2/2010 | Conway | A47G 3/00 | 411/374 |
| D639,152 S * | 6/2011 | Watts | D8/387 | |
| 2008/0184469 A1 * | 8/2008 | Johnson | E03D 11/16 | 4/252.1 |

* cited by examiner

*Primary Examiner* — Huyen Le
(74) *Attorney, Agent, or Firm* — Bruce J. Bowman

(57) ABSTRACT

A toilet fastening system includes a bolt, a nut, and a cap, the bolt and nut each configured with ratchet or ratchet-like portions that define a ratchet or ratchet-like constructs between the bolt and nut to provide controlled tightening (rotation) of the nut onto the bolt, audible confirmation of nut tightening, and tactile user feedback while aiding in preventing back off of the nut relative to the bolt, the cap joining with the nut such that the cap becomes the tightening and loosening tool for the nut as well as the finished beauty cap for the toilet fastening system. The bolt has an offset foot with curved inner and outer surfaces for positive orientation and seating of the bolt into the toilet flange.

20 Claims, 11 Drawing Sheets

TOILET FASTENING SYSTEM

CROSS-REFERENCE TO RELATED APPLICATIONS

This U.S. non-provisional patent application is a continuation-in-part of co-pending U.S. non-provisional patent application Ser. No. 14/826,672 filed Aug. 14, 2015 titled "Toilet Fastening System," which is a continuation of now abandoned U.S. non-provisional patent application Ser. No. 14/242,470 filed Apr. 1, 2014 titled "Toilet Fastening System," the entire contents of each of which is specifically incorporated herein by reference.

BACKGROUND OF THE INVENTION

Field of the Invention

The present invention relates generally to the field of hardware and, more particularly, to toilet fasteners used between a toilet base and a toilet flange.

Description of the Prior Art

A toilet fastener is positioned between the base of a toilet and the upwardly facing toilet flange provided on the floor drain. A standard toilet fastening system consists of a metal bolt with rectangular base that slides into the bolt channel on the toilet flange and protrudes upward through the toilet base, a beauty cap plate, a metal washer, a metal nut, and finally a beauty cap. The object of the toilet fastener is to provide a means of holding the toilet to the flange. However, many of the prior art fasteners become loose or deteriorate, thereby developing leaks allowing fluid and/or gaseous waste to escape.

The standard toilet bolt is produced from various metals. If the bolt comes into contact with moisture and it is made out of a steel it will rust and has to be removed for repair. The toilet bolt is difficult to observe as the toilet bolt is covered with a beauty cap hiding deterioration of the nut and bolt.

The base of a standard toilet bolt has a rectangular shaped design for the purpose of keeping the toilet bolt in the flange. However, due to the varying widths and shapes of bolt channels on flanges, the standard toilet bolt can become dislodged due to the design of the base of the toilet bolt. Furthermore, the standard toilet bolt can spin in the bolt channel due to the varying widths and shapes of the bolt channels making it difficult to tighten and untighten the nut on the toilet bolt without the toilet bolt becoming dislodged from the flange.

The standard toilet nut and bolt configuration allows the nut to loosen by backing up on the threads due to the angle of the thread pattern and the movement and rocking of the toilet base. The standard nut is also made of various metals. If the nut comes into contact with moisture and it is made out of a steel it will rust and has to be removed for repair. The standard nut has a hexagon shape about ⅜" wide and 3/16" tall requiring the use of tools for tightening and a metal washer to keep the nut from going through the toilet base.

The standard beauty cap plate is installed before the metal washer and nut for the purpose of holding the cap over the washer, nut and cut bolt. Therefore if the metal washer and metal nut become rusted or loose, the cap has to be removed and tools must be used to re-tighten the nut, if the nut and bolt are not too deteriorated. If the nut and or bolt are heavily rusted the use of saws, grinders or other tools would need to be used for removal. Furthermore, the cap keeps the metal nut and metal washer hidden from view obstructing the ability to see if it has become loose or begun to deteriorate.

Currently there are a number of toilet to flange fastening system options. Some of these options use a steel bolt, or other metals, a nut, a washer, a cap plate and a cap, however, these options fail to meet the need of the industry because the parts can deteriorate/rust, become loose, and remain hidden by the cap allowing the problem to get worse. Other options attempt to use nylon as a bolt and nut material. However, this is similarly unable to meet the industry needs as it only solves the deterioration/rust problem and are easily loosened by the angle of the threading and the movement of the toilet, and the foot can still become loose in the flange and require tools to tighten/repair. Still other options attempt to use a redesigned foot on the bolt, but due to the varying widths and shapes of the bolt channels on flanges they still become dislodged and spin while trying to tighten.

These and other options are shown in, and a number of U.S. patents have been granted on toilet bolts. U.S. Pat. No. 7,954,179 issued to Johnson discloses a bolt with an oblong foot and male or female notches at the top of the bolts to visualize the direction of the foot and allow the use of tools to prevent spinning. U.S. Pat. No. 5,222,851 issued to Dickerson discloses a bolt with round foot and protrusion extending vertically from the top face of the foot for preventing spinning in the flange bolt channel. U.S. Pat. No. 4,530,629 issued to Sakow, discloses an oval foot for preventing spinning in the flange bolt channel.

In view of the above, and without being exhaustive, what is clearly needed is a toilet to flange fastening system that does not rust or deteriorate, does not allow the nut to back off and become loose, does not allow the foot of the bolt to become dislodged and spin in the flange, does not require tools for tightening and repair, and installs with fewer pieces.

SUMMARY OF THE INVENTION

A non-corrosive, re-tightenable, tool-less toilet fastening system, used for fastening the toilet to the flange and holding it securely in place. This toilet fastening system is primarily constructed of a non-corrosive material, having a threaded bolt with an off-set designed foot on one end and one or more grooves or channels (e.g. two channels 180 degrees apart) extending generally vertical through the threading of the bolt to receive pawls, tabs, flanges or the like of a cooperating nut. The pawls of the nut and the configuration of the grooves of the bolt define a ratchet assembly between the nut and the bolt to keep the nut from becoming loose from a tightened position. A tightening cap, which is received by the nut once received onto the bolt shaft, then becomes a combined tool (part of the tightening mechanism) and does not require removal for re-tightening of the nut to bolt configuration, nor does it require the use of extraneous tools.

The non-corrosive material for one, all, or several of the bolt, nut, and cap would be preferably, but not limited to, a plastic, composite, ceramic, or non-metallic substance.

The present invention is superior when compared to other known devices and solutions because the present invention provides superior fastening of the toilet to the toilet flange. Moreover, the present invention is reusable, non-corrosive, requires no tools to tighten or re-tighten, will not allow the foot to spin in the bolt channel of the toilet flange or become dislodged therefrom, the nut will not loosen with movement or rocking of the toilet, and is antimicrobial. In addition, the cap joins with the nut and is used for re-tightening without removing the cap and without a wrench or other tools.

In one form, the present toilet fastening system comprises a bolt, a nut, and a cap. The bolt and nut have ratchet or similar portions that define ratchet or similar assemblies between the bolt and nut to provide controlled tightening of the nut onto the bolt with audible and tactile user feedback while providing anti back off of the nut relative to the bolt. The cap conjoins with the nut such that the cap becomes the tightening and loosening tool for the nut as well as the finished beauty cap for the toilet fastening system.

It is an object of the present invention to provide a new and improved toilet fastening system for securing a toilet base to a floor flange.

A further object of the present invention is to provide an anti-back-off securement system for nut to bolt configuration.

In addition, it is an object of the present invention to provide a superior foot for the base of the bolt for the purpose of preventing spinning of the bolt in the flange bolt channel and to prevent dislodging of the bolt from the flange while the user is tightening the nut onto the bolt via the cap.

In addition, it is an object of the present invention to provide a toilet fastening system wherein the cap and nut act as a single part during installation for the purpose of initial tightening of the nut onto the bolt, re-tightening of the nut onto the bolt, and loosening the nut from the bolt; the cap serving two purposes as a tool and as a clean-lined beautification covering (beauty cap) over the exposed nut and bolt.

Without being exhaustive, further objects of the present invention are to provide a toilet to flange fastening system that provides tactile and/or audio feedback during installation, that can be easily tightened after installation such as while sitting on the toilet, that allows for selection of an angle of reception for the toilet bolt fastening system nut onto the toilet bolt fastening system bolt, and that keys the toilet bolt fastening system cap to the toilet bolt fastening system nut for installing/tightening the toilet bolt fastening system nut to the toilet bolt fastening system bolt.

Related objects and advantages of the present invention will be apparent from the following description.

BRIEF DESCRIPTION OF THE DRAWINGS

The above mentioned and other features, advantages and objects of this invention, and the manner of attaining them, will become apparent and the invention itself will be better understood by reference to the following description of forms of the invention taken in conjunction with the accompanying drawings, wherein.

Like reference numerals indicate the same or similar parts throughout the several figures.

DETAILED DESCRIPTION OF THE INVENTION

Figure 1:
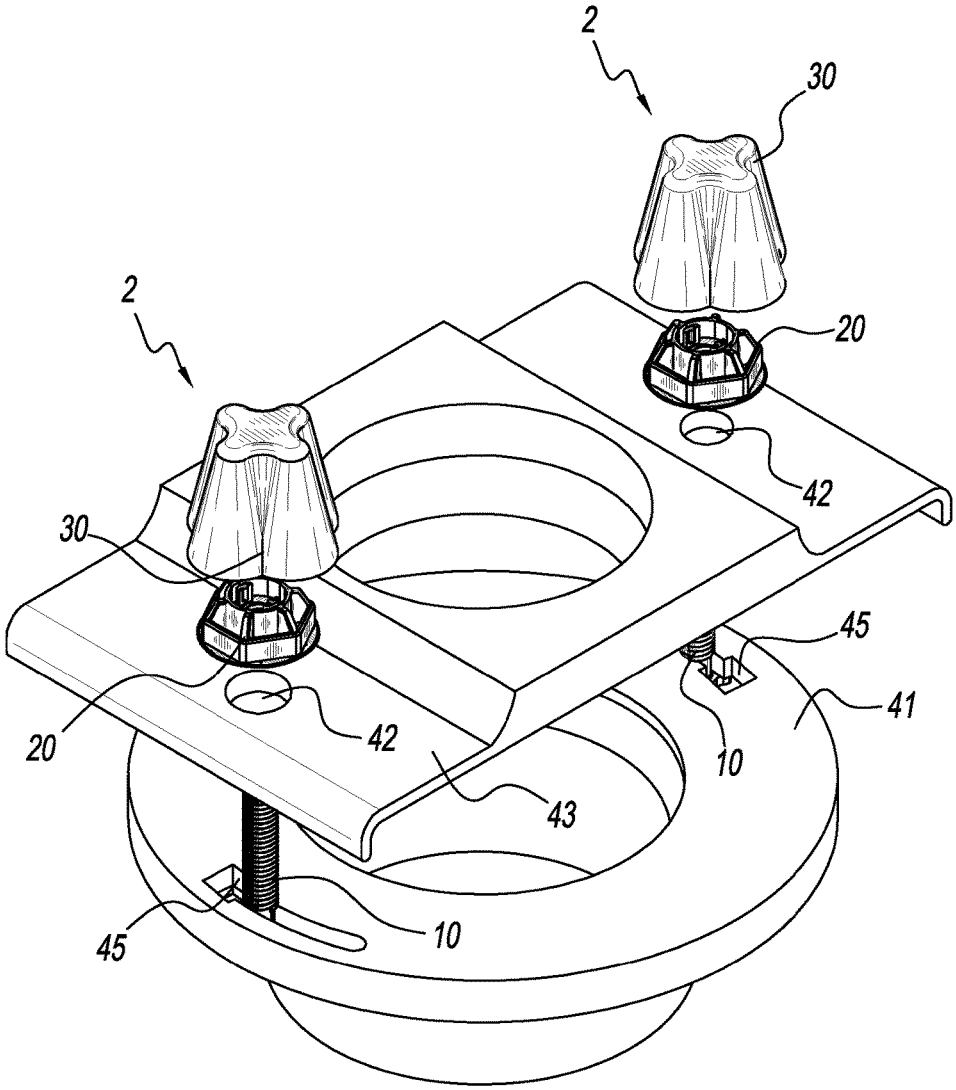
FIG. 1 is an exploded view of a toilet fastening system according to the principles of the present invention positioned between a toilet base attached to a floor flange and a toilet outlet base.
Figure 2:
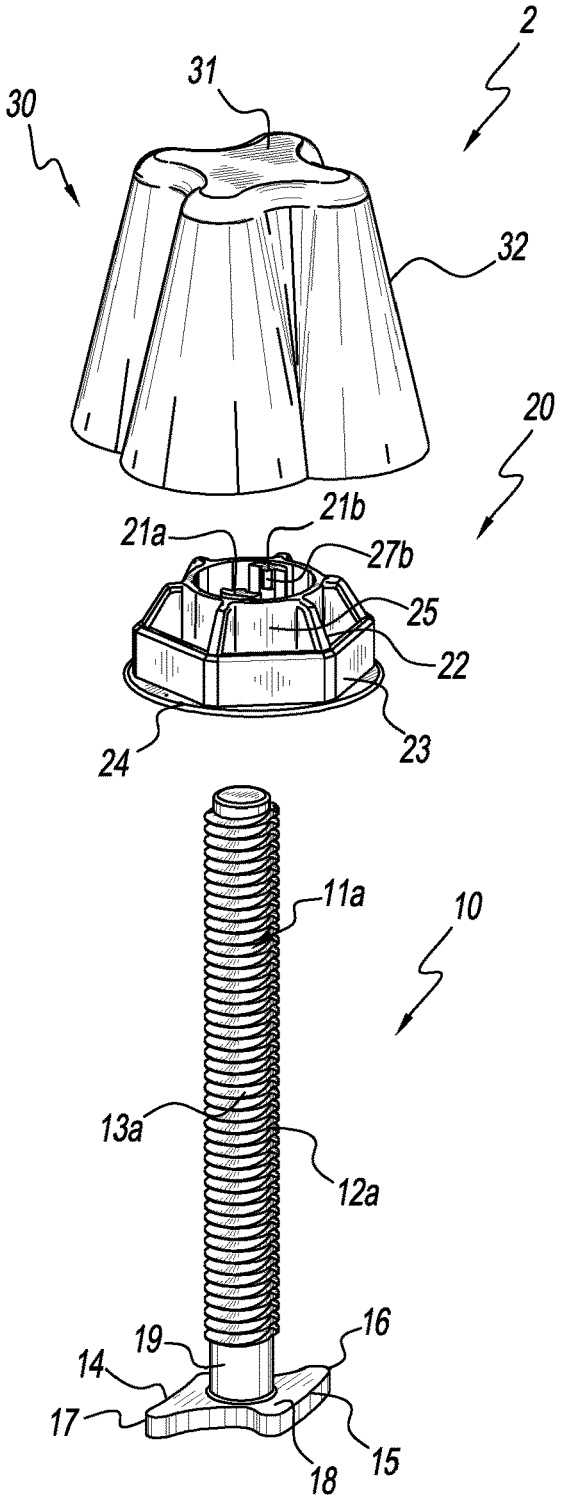
FIG. 2 is an exploded upper view of the toilet fastening system of FIG. 1.
Figure 3:
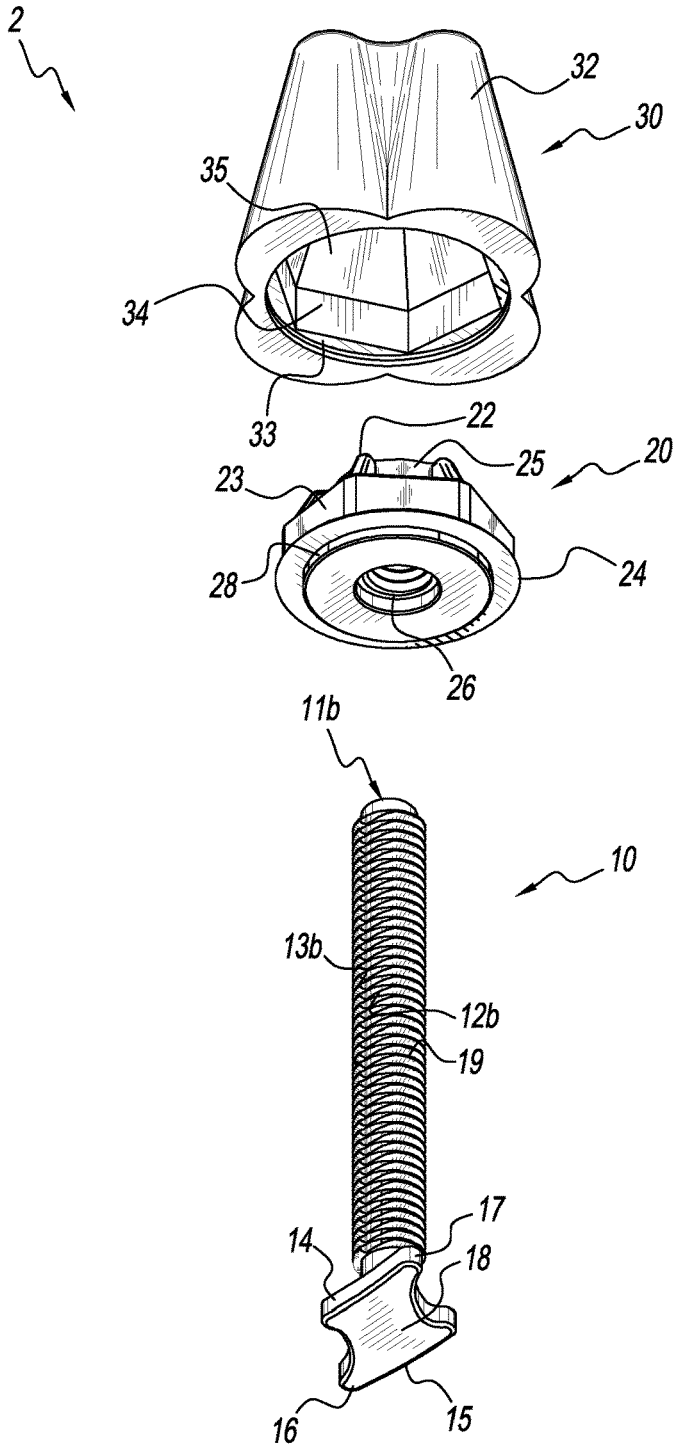
FIG. 3 is an exploded bottom view of the toilet fastening system of FIG. 2.
Figure 4:
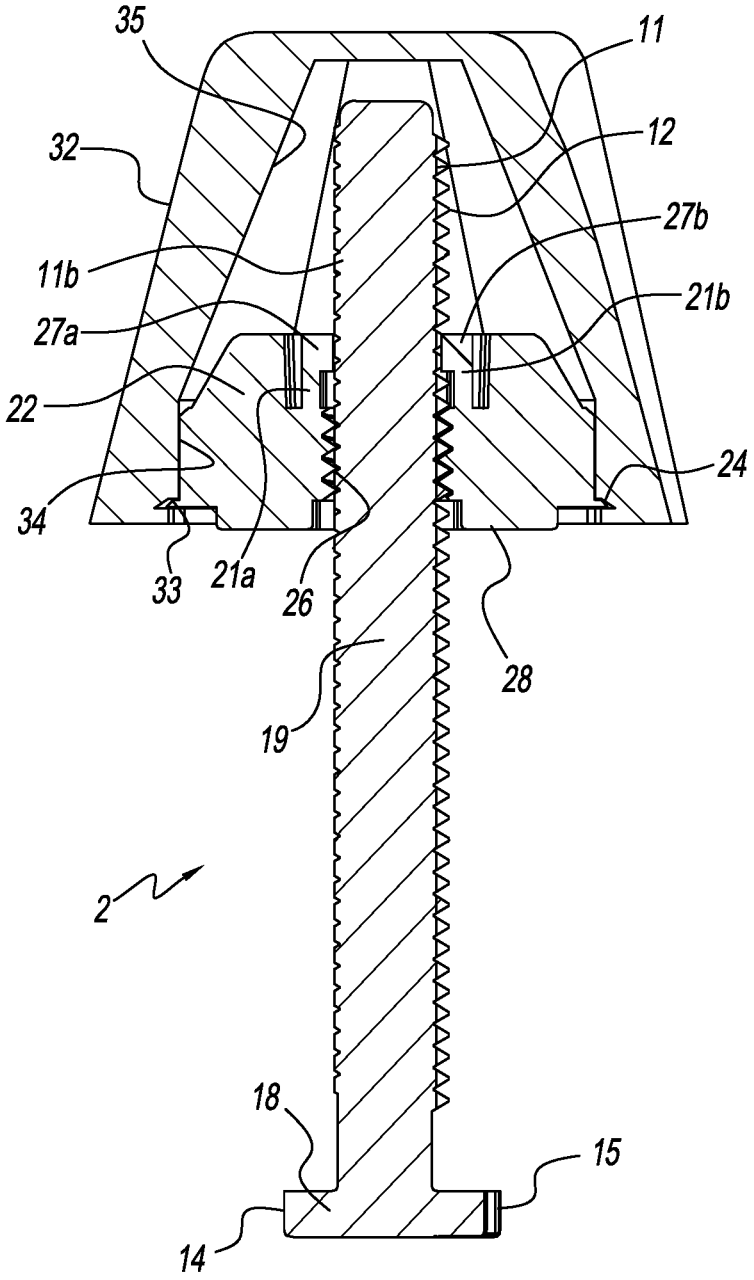
FIG. 4 is a cross-sectional view of the toilet fastening system of FIG. 1, assembled.

For the purposes of promoting an understanding of the principles of the invention, reference will now be made to the forms illustrated in the drawings and specific language will be used to describe the same. It will nevertheless be understood that no limitation of the scope of the invention is hereby intended, such alterations and further modifications in the illustrated devices, and such further applications of the principles of the invention as illustrated herein being contemplated as would normally occur to one skilled in the art to which the invention relates.

Referring to FIG. 1, there is shown a toilet fastening system 2 comprising a bolt 10 positioned in a bolt channel 45 of a toilet flange 41 protruding upward and through the bolt passage 42 in the toilet base 43, in turn to be threaded through a nut 20 thereof, and thereafter a cap 30 thereof, fits onto and becomes a tool for manipulating the nut 20. Herein, the use of non-corrosive substances will be deemed to encompass all suitable materials for the present toilet fastening systems.

The bolt 10 includes an offset foot 18 with a shaft 19 extending vertically from an upper face of the foot. A threading is attached to or formed to and/or around the surface of the shaft 19 and having two channels 11*a*, 11*b* extending vertically through the threading 180 degrees (180°) apart from the other. The foot 18 has an inside curved planar surface 14 and an outside curved planar surface 15, which follow the contour of a flange bolt channel (see e.g., flange channel 45 of FIG. 1). The inside curved planar surface 14 begins near the front side of the threaded shaft extending horizontally toward the back to form a rear toe 17 and the outside curved planar surface 15 begins near the back side of the threaded shaft extending horizontally toward the front to form a front toe 16 making an offset planar foot while maintaining the ability to fit the foot into the flange bolt channel 45.

The foot 18 is positioned in the bolt channel 45 of the toilet flange 41 with the threaded shaft 19 extending vertically through the bolt passage 42 of the toilet base 43.

The nut 20 includes a shelled hexagonal body 23 that extends upwardly from the downwardly facing bottom surface with fins 22 extending inwardly from each corner of the hexagonal shape meeting at the wall of the partially shelled cylinder 25 that extends upwardly from the planar upper surface of the hexagonal body 23 and includes an internally threaded bore 26. The cylinder 25 preferably, but not necessarily, has a height 100% greater than the height of the hexagonal body 23. The fins 22 are filleted from where they meet the top plane of the hexagon body 23 to the middle of the top plane of the fins 22. At the center of the cylinder 25 the threaded passage 26 is bored vertically through the nut 20 and has two locking tabs 21*a*, 21*b* extending vertically 180 degrees (180°) apart from the edge of the opening of the threaded passage 26 (although more or less locking tabs 21 may be used). A protrusion 27*a*, 27*b* runs vertically along the center of the interior face of each locking tab 21*a*, 21*b*. At the base of the hexagonal body 23 is a thin cylinder 24 with a diameter greater than the width of the hexagonal body 23 and a filleted outer edge (i.e. rim, base, seat, etc.). At the undersurface of the base/cylinder 24 is a cylinder 28 with a diameter less than the width of the hexagonal body 23 and a height great enough to allow the cap 30 to join with the nut 20, even as the nut 20 bottoms out on the toilet base 43 or other surface.

The nut 20 is placed onto the top of the threaded shaft 19 and turned a clockwise direction for tightening. As the nut is turned down the shaft the tab protrusions 27 meet the threading and the locking tabs 21 are deformed outwardly. The tab protrusions 27 then turn over the channel shelf 12 and fall into the channels 11, returning the locking tabs 21 to their original shape. The deformation process may create deformation sounds such as clicking. As the nut is turned further down the threaded shaft 19 the tab protrusions 27 rise over the channel exits 13*a*, 13*b* of the channels 11*a*, 11*b*, deforming the locking tabs 21 outwardly in a continuous process until rotation is stopped. The deformation sounds are created during rotation of the nut 20 on the bolt 10.

The cap 30 extends upwardly from the planar downwardly facing bottom surface in four (4) melded conical shapes 32 to the upwardly facing planar surface 31. The shape of the cap is not limited to a conical shape and can be a dome, cube, cylinder, pyramid or other. The downwardly facing flat or planar surface of the cap 30 is extruded upwardly with a cylindrical shape that is extruded outwardly to create the ledge 33 for accepting the thin cylinder 24 of the nut 20. The downwardly facing surface thereof is further extruded upwardly with a hexagonal shape 34 a distance equaling the height of the hexagonal body 23 of the nut 20 then narrowing at an angle equal to the fillet of the fins 22 of nut 20 forming the hexagonal pyramid shaped cavity 35. The cavity 35 thereof receives the hexagonal body 23 of the nut 20 and thereafter receives the thin cylinder (base, rim, etc.) 24 of the nut 20 into the circular ledge 33 of the cap 30, joining them into one conjoined part.

As seen in FIG. 1, a pair of bolts 10 have offset feet 18 positioned into bolt channels 45 provided 180 degrees (180°) apart on flange 41. A pair of accurate shaped slots extend from each opening of the bolt channels 45 with each slot having a counter bore or enlarged lower opening enabling the foot 18 of each bolt 10 to be extended through the openings of the bolt channels 45 while the threaded shaft 19 of the bolt 10 is extended upwardly. The threaded shafts 19 may be moved along the lengths of the accurate slots to distance the foot 18 apart from openings of the bolt channels 45 preventing accidental disengagement of the bolt from the flange.

Each offset foot has an inside curved planar surface 14 and outside curved planar surface 15 following the curvature of the accurate slots with the inside planar surface 14 being offset from the outside planar face 15. Each threaded shaft 19 then extends through or by the toilet seal. Each threaded shaft 19 then extends through passages 42 located 180 degrees (180°) apart on the upper surface of the toilet base 43.

Once the bolts 10 pass through the toilet base 43 the nut 20 is screwed on in a clockwise direction for fastening the toilet base 43 to the toilet flange 41. As the nut 20 is turned clockwise down the threaded shaft 19, the locking tabs 21 grab at the locking channels 11 running vertically 180 degrees apart on the threaded shaft 19 preventing unintended counterclockwise turning of the nut 20 on the threaded shaft 19. The nuts 20 are tightened by hand or tool to a snug position when the toilet base 43 is secured to the toilet flange 41 and then the excess threaded shafts 19 of the bolts 10 extending out of the top of the nuts 20 are removed. The present description is based on right handed threads/threading for the bolt and nut, however, left handed threads/threading may be used.

The caps 30 are then joined onto the nuts 20 by aligning the hexagonal shaped structure 23 on the nuts 20 to the hexagonal cavity 34 of the caps 30, to be as one. The caps 30 are then able to be turned in a clockwise direction tightening the nuts 20 down the threaded shafts 19 of the toilet base, without the use of additional tools and with audible confirmation (e.g. clicking) of tightening of the nut.

Figure 5:
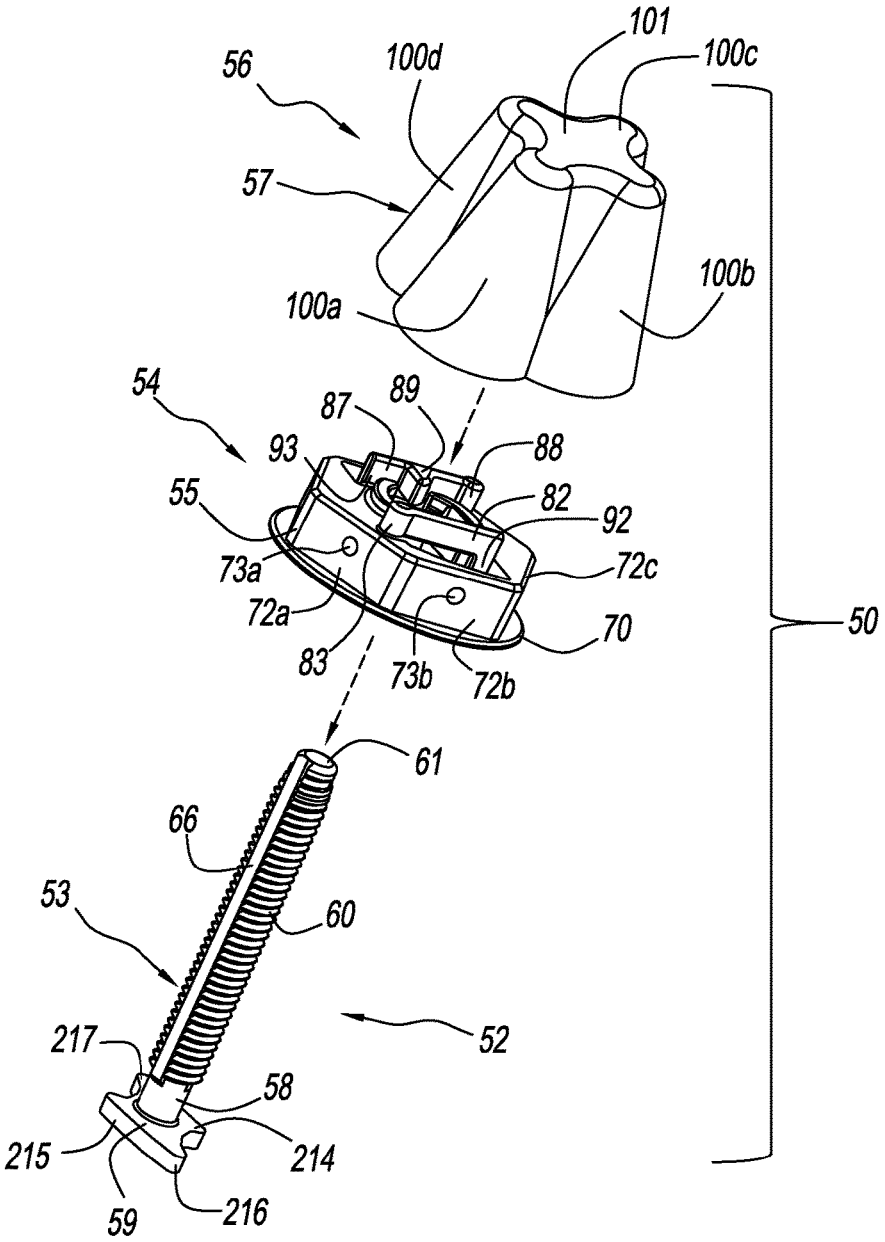
FIG. 5 is an exploded view of another toilet fastening system according to the principles of the present invention.

Referring to FIG. 5, there is depicted another toilet fastening system 50 fashioned in accordance with the present principles, the toilet fastening system 50 shown in an exploded view such that its three (3) components, namely, a bolt 52, a nut 54, and a multi-function cap 56 are easily seen. The toilet fastening system 50 is used for and/or in the same manner as the toilet fastening system 2 of FIGS. 1-4. As such, the description of the toilet fastening system 2 is applicable to and hereby incorporated into the toilet fastening system 50 unless indicated otherwise.

Figure 6:
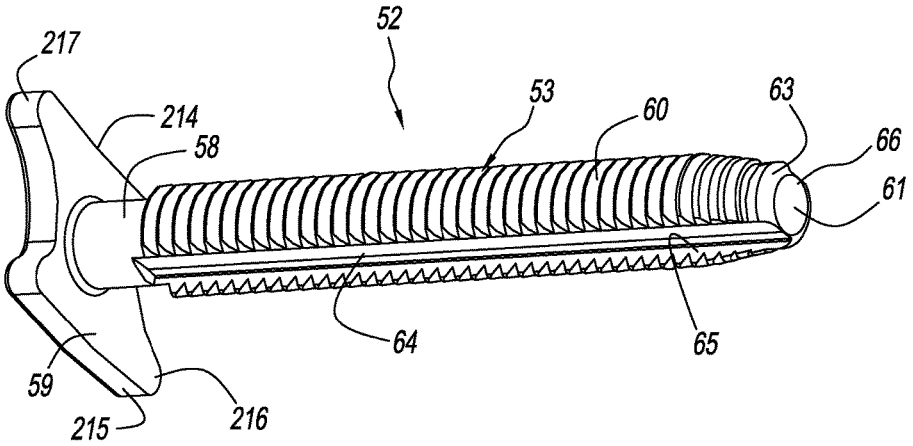
FIG. 6 is an isometric view of a bolt for the toilet fastening system of FIG. 5.
Figure 7:
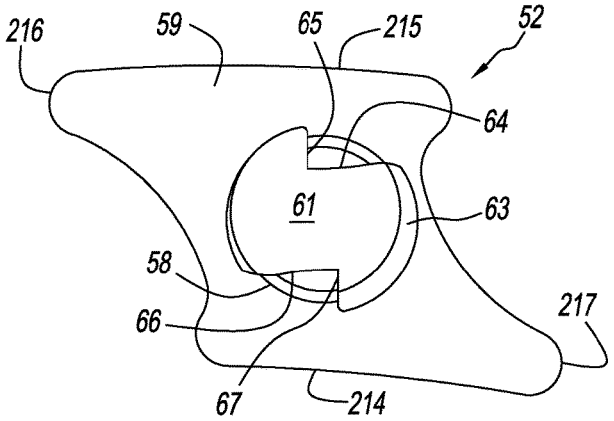
FIG. 7 is a top plan view of the bolt of FIG. 6.

Referring additionally to FIGS. 6-7, the bolt 52 has a body 53 with an offset foot 59, and a shaft 58 extending vertically from an upper face of the foot 59. A threading 60 is attached to or formed to, in, and/or around the surface of an upper portion of the shaft 58 and terminating in an end, nose or the like 61. The shaft 58 preferably, but not necessarily, has two (2) channels, grooves, troughs or the like (collectively and hereinafter, grooves) 64, 66 extending generally vertically through the threading 60 from the nose 61 to proximate the foot 59. While two (2) grooves are shown, the bolt 52 may have one (1) groove or more than two (2) grooves if desired. In the present embodiment, the two grooves are disposed 180 degrees (180°) apart from the other. However, spacing other than 180° may be used.

As seen in FIG. 7, the axial or longitudinal groove 64 is formed into the shaft 58 so as to provide an axial or longitudinal side, surface, ledge, cutout, or the like 65. It may be off-axis or skew if desired. The side 65 extends radially inward toward the longitudinal axis of the shaft 58 and is generally perpendicular to the opposite side of the groove. The side 65 defines an angle of attack for the nut. The angle of attack can be changed by the angle of the side 65 relative to the opposite side. Clockwise threading or rotation of the nut 54 onto the bolt 52 reaches a drop off or ledge due to the side 65. Counterclockwise nut rotation meets against the ledge, drop-off or the like 65, resisting back off of the nut 54 from the bolt 52. Likewise, the groove 66 is formed into the shaft 58 so as to provide an axial or longitudinal side, surface, ledge, cutout or the like 67. It may be off-axis or skew if desired. The side 67 extends radially inward toward the longitudinal axis of the shaft 58 and is generally perpendicular to the opposite side of the groove. The side 67 defines an angle of attack for the nut. The angle of attack can be changed by the angle of the side 65 relative to the opposite side. Clockwise threading or rotation of the nut 54 onto the bolt 52 reaches a drop off or ledge due to the side 67. Counterclockwise nut rotation meets against the ledge, drop-off or the like 67, resisting back off of the nut 54 from the bolt 52. The grooves and their sides aid in preventing reverse rotation of the nut 54 and thus may be considered a part of a ratchet/ratchet assembly between the bolt 52 and the nut 54.

The foot 59 has an inside curved planar surface 214 and an outside curved planar surface 215, which follow the contour of a flange bolt channel (see e.g., flange channel 45 of FIG. 1). The inside curved planar surface 214 begins near the front side of the threaded shaft extending horizontally toward the back to form a rear toe 217 and the outside curved planar surface 215 begins near the back side of the threaded shaft extending horizontally toward the front to form a front toe 216 making an offset planar foot while maintaining the ability to fit the foot into the flange bolt channel 45. The foot 59 is positioned in the bolt channel 45 of the toilet flange 41 with the threaded shaft 59 extending vertically through the bolt passage 42 of the toilet base 43 (see, e.g., FIG. 1).

Figure 8:
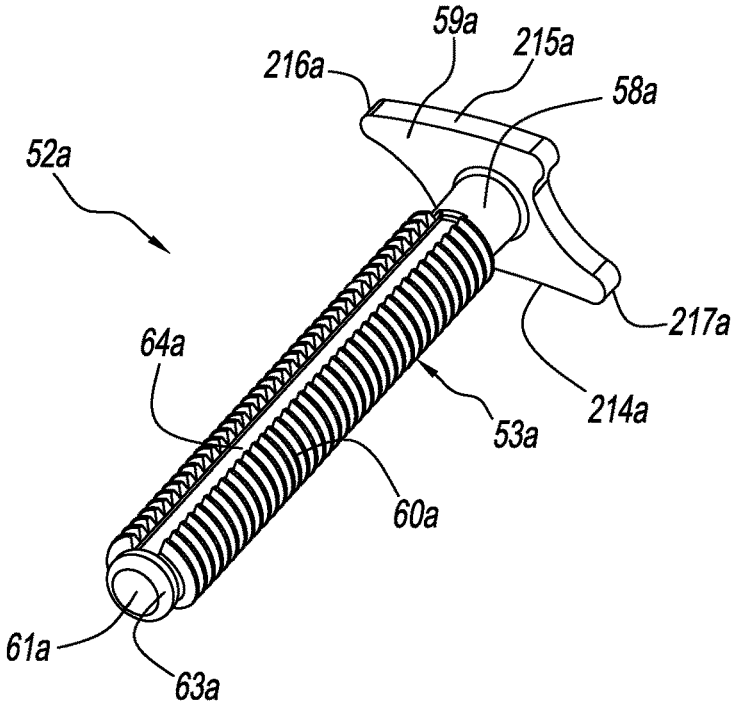
FIG. 8 is an isometric view of another bolt that can be used with the present toilet fastening system.
Figure 9:
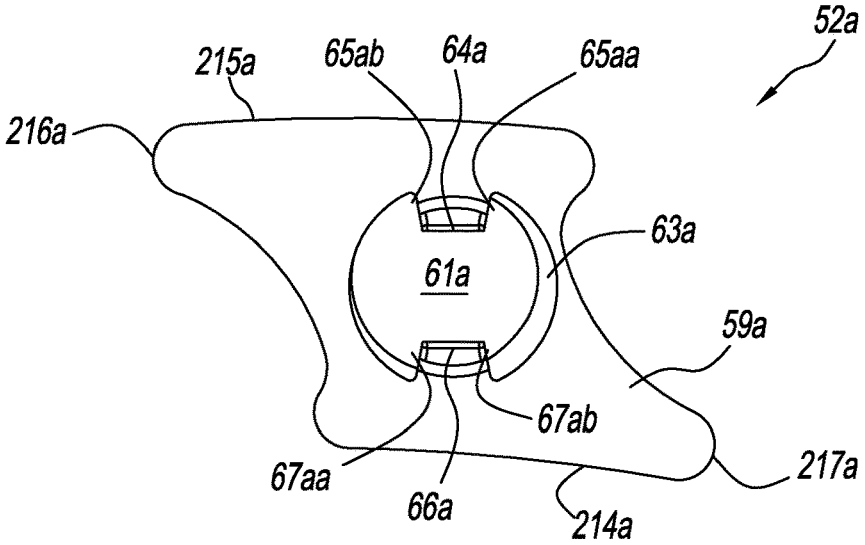
FIG. 9 is a top plan view of the bolt of FIG. 8.
Figure 10:
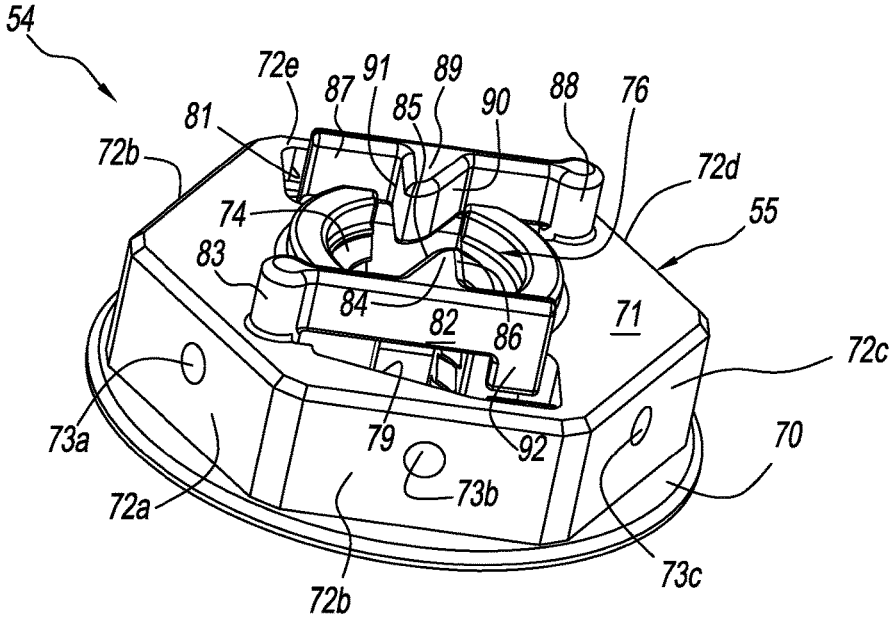
FIG. 10 is an isometric view of a nut for the toilet fastening system of FIG. 5.
Figure 11:
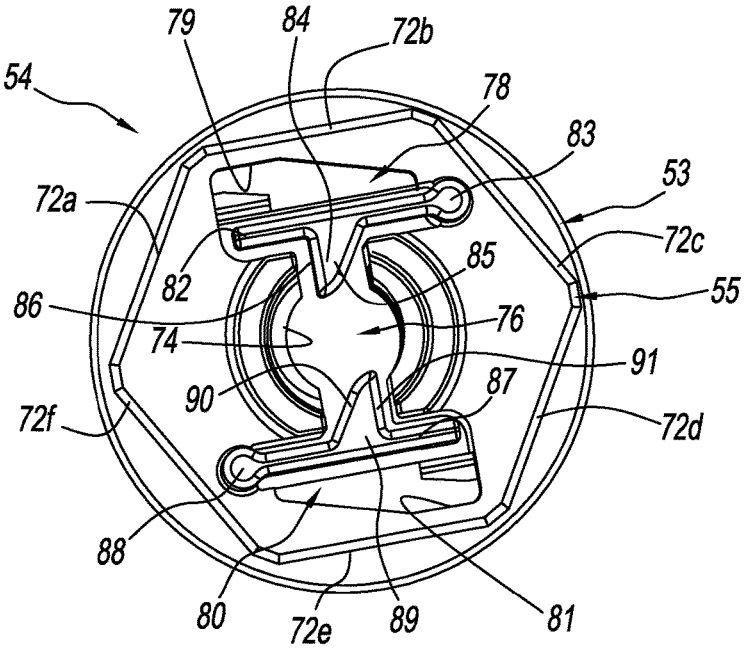
FIG. 11 is a top plan view of the nut of FIG. 10.

Referring to FIGS. 8 and 9, there is depicted another bolt 52*a* that may be used with the toilet fastening system 50. The bolt 52*a* generally has the same features, components, functions, and the like as the bolt 52 and such features, components, functions, and the like of the bolt 52*a* are thus labeled the same as the bolt 52 but with a following "a." Features, components, functions, and the like of the bolt 52*a* that are different from the bolt 52 are labeled differently. The groove or channel 64*a* is generally rectangular but with outwardly angled sides 65*aa*, 65*ab*. The channel 66*a* likewise is generally rectangular but with outwardly angled sides 67*aa*, 67*ab*. The outwardly angled sides 65*aa*, 65*ab* of the channel 64*a* provides an angled ledge, drop-off or the like 65*ab* during clockwise threading of the nut 54 onto the bolt 52*a*, while counterclockwise nut rotation meets against the ledge, drop-off or the like 65*aa*, resisting back off of the nut 54 from the bolt 52*a*. The outwardly angled sides 67*aa*, 67*ab* of the channel 66*a* provides an angled ledge, drop-off or the like 67*ab* during clockwise threading of the nut 54 onto the bolt 52*a*, while counterclockwise nut rotation meets against the ledge, drop-off or the like 67*aa*, resisting back off of the nut 54 from the bolt 52*a*. The channels and their sides aid in preventing reverse rotation of the nut 54 and thus may be considered a part of a ratchet/ratchet assembly between the bolt 52 and the nut 54. The channels of the bolt may take other shapes as desired.

The nut 54 has a body 53 having a generally hexagonal platform 55 that extends upwardly from a generally disk shaped base 70, the hexagonal body having six (6) outwardly facing sides, surfaces, walls, or the like ("sides") 72*a*, 72*b*, 72*c*, 72*d*, 72*e*, 72*f*, each outwardly facing side 72*a-f* having a respective detent, dimple, hole or the like ("detent") 73*a-f* for receipt of complementary protrusions on the inside of the cap 56 (or vice versa). The base 70 provides a seat for the cap 56. A first ratchet portion 78 is situated about a side of the threaded center 74 defining an axial opening 76, while a second ratchet portion 80 is situated about another side of the threaded center 74 (the nomenclature first and second being arbitrary), the number of ratchet portions corresponding in number to the number of channels in the bolt. The first ratchet portion 78 includes a cavity 79 in the platform 55 that is sized to allow pivoting movement of a resilient/spring arm 82 which extends from a pivot point/post 83. The resilient arm 82 has a pawl 84 that extends radially into the threaded center 74, the pawl 84 defining an angled side 85 and a planar side 86, the angled side 85 being the leading side during clockwise rotation of the nut 54 (and thus the planar side 86 is the trailing side during clockwise rotation of the nut 54) and vice versa for counterclockwise rotation. The resilient arm 82 allows the pawl 84 to flex radially in and out relative to the center 76 in order to co-act with the bolt. The second ratchet portion 80 includes a cavity 81 in the platform 55 that is sized to allow pivoting movement of a resilient/spring arm 87 which extends from a pivot point/post 88. The resilient arm 87 has a pawl 89 that extends radially into the threaded center 74, the pawl 89 defining an angled side 90 and a planar side 91, the angled side 90 being the leading side during clockwise rotation of the nut 54 (and thus the planar side 91 is the trailing side during clockwise rotation of the nut 54) and vice versa for counterclockwise rotation. The resilient arm 87 allows the pawl 89 to flex radially in and out relative to the center 76 in order to co-act with the bolt. The first and second pawls 84, 89 provides two locking tabs or pawls 84, 89 that are 180 degrees (180°) apart from each other, corresponding to the grooves in the bolt shaft.

The pawls 84, 89 resiliently drop into a groove/channel 64, 66 of the bolt shaft 58 during tightening (rotation in one direction) of the nut 54 but resist counter rotation (loosening of the nut 54) due to the stop surface/sides 65, 67. Moreover, the resilient pawls create an audible sound (e.g. clicking or snapping) as the pawls drop into and out of the bolt grooves as well as creating a tactile response or "feel" by the user through the cap 56 as the cap and nut combination advances the nut onto the bolt.

The nut 54 is placed onto the top of the threaded shaft 58 and turned a clockwise direction for tightening (right-handed threading, but left-handed threading may be used). As the nut is turned down the shaft the tab protrusions/pawls 84, 89 meet the threading and are deformed radially outwardly. The pawls 84, 89 then turn over the groove/channel shelf and fall into the grooves/channels 64, 66, returning the pawls 84, 89 and spring arms 82, 87 to their original shape/position. The deformation process preferably, but not necessarily create a deformation sound such as clicking or snapping, as well as provide tactile feedback to the user. As the nut 54 is turned further down the threaded shaft 58 the pawls 84, 89 rise over the groove exits, deforming the pawls outwardly in a continuous process until rotation is stopped.

Figure 12:
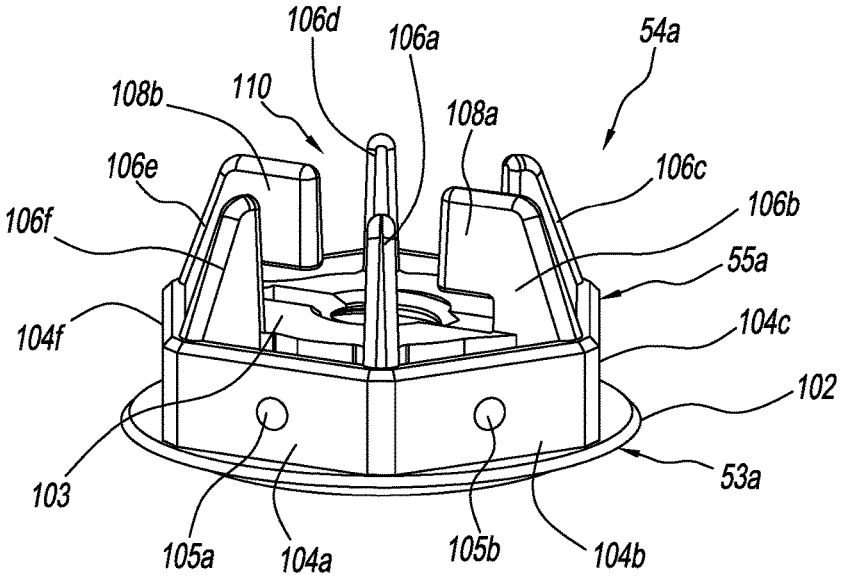
FIG. 12 is an isometric view of another nut that can be used with the present toilet fastening system.
Figure 13:
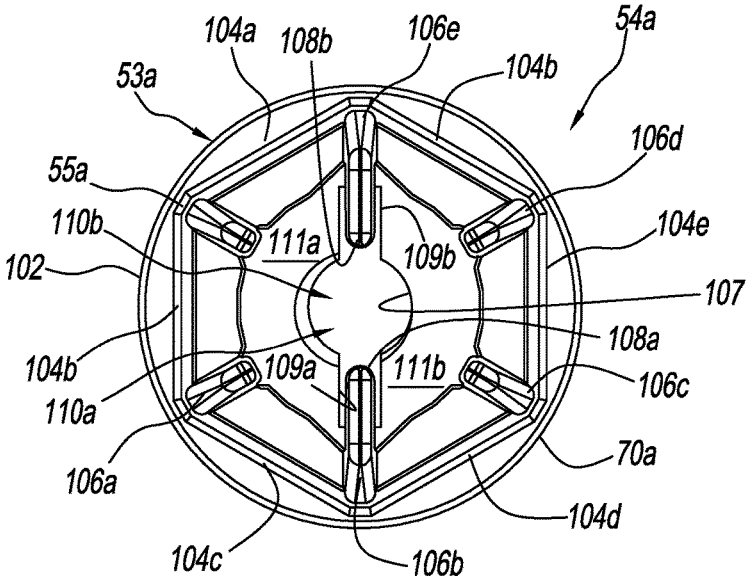
FIG. 13 is a top plan view of the nut of FIG. 12.

Referring to FIGS. 12 and 13, there is shown an alternate nut, generally designated 54*a*, which may be used with the toilet fastening systems 2, 50. The nut 54*a* generally has the same features, components, functions, and the like as the nut 54 and such features, components, functions, and the like of the nut 54 are thus labeled the same as the nut 54 but with a following "a." Features, components, functions, and the like of the nut 54*a* that are different from the nut 54 are labeled differently.

The nut 54*a* has a body 53*a* having a generally hexagonal wall 55*a* that extends upwardly from a generally disk shaped base 70*a*, the hexagonal wall having six (6) outwardly facing sides, surfaces, walls, or the like ("walls") 104*a*, 104*b*, 104*c*, 104*d*, 104*e*, 104*f*, (the alphabet nomenclature being arbitrary) each outwardly facing wall 104*a-f* having a respective detent, dimple, hole or the like ("detent") 105*a*, 105*b*, 105*c*, 105*d*, 105*e*, 105*f* (the alphabet nomenclature being arbitrary) for receipt of complementary protrusions on the inside of the cap 56 (or vice versa). The base 70*a* also provides a seat for the cap 56.

A middle or center section or platform formed by two platform portions 111*a*, 111*b* is disposed interior to the walls 104*a-f* and defines a central threaded hole or bore 107 that is sized and configured for reception on the threaded bolt shaft 58. Six ribs 106*a*, 106*b*, 106*c*, 106*d*, 106*e*, 106*f* (the alphabet nomenclature being arbitrary) project axially from the corners of the walls 104*a-f*, however, other any number of ribs can be used. The rib 106*b* includes/defines a first ratchet portion 110*a* situated about a side of the threaded center 107, while the rib 106*e* includes/defines a second ratchet portion 110*b* situated about another side of the threaded center 107 (the nomenclature first and second being arbitrary), the number of ratchet portions corresponding in number to the number of channels in the bolt. The first ratchet portion 110*a* includes a flange 108*a* that extends radially inwardly from the upper end of the rib 106*b* and axially over/into the longitudinal axis of the threaded center 107. The flange 108*a* resiliently flexes side to side during rotation of the nut 54*a* in order to co-act with the bolt. The second ratchet portion 110*b* includes a flange 108*b* that extends radially inwardly from the upper end of the rib 106*e* and axially over/into the longitudinal axis of the threaded center 107. The flange 108*b* resiliently flexes side to side during rotation of the nut 54*a* in order to co-act with the bolt. The first and second flanges, tabs or pawls 108*a*, 108*b* are 180 degrees (180°) apart from each other, corresponding to the grooves in the bolt shaft.

The tabs 108*a*, 108*b* resiliently drop into a groove/channel 64, 66 of the bolt shaft 58 during tightening (rotation in one direction) of the nut 54*a* but resist counter rotation (loosening of the nut 54*a*). Moreover, the resilient tab create an audible sound (e.g. clicking or snapping) as the tabs drop into and out of the bolt grooves as well as creating a tactile response or "feel" by the user through the cap 56 as the cap and nut combination advances the nut onto the bolt.

Figure 14:
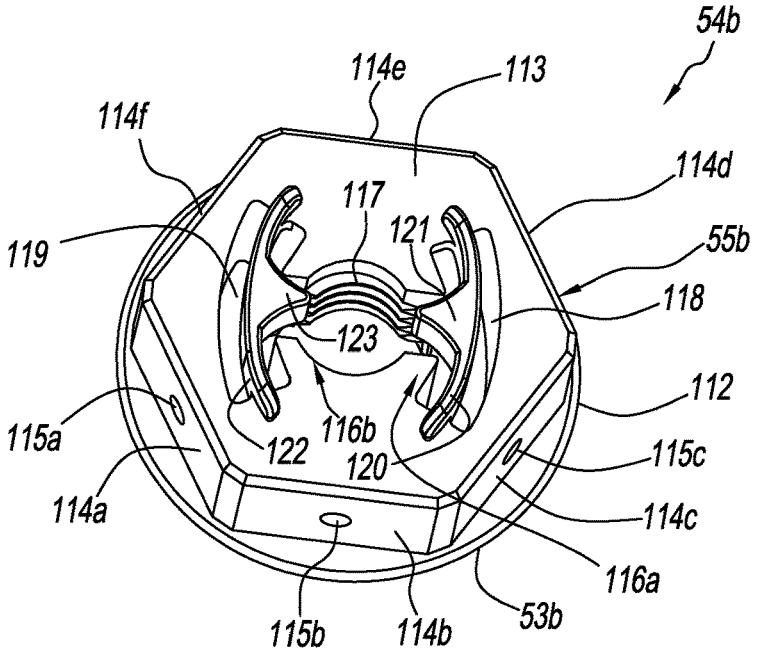
FIG. 14 is an isometric view of another nut that can be used with the present toilet fastening system.
Figure 15:
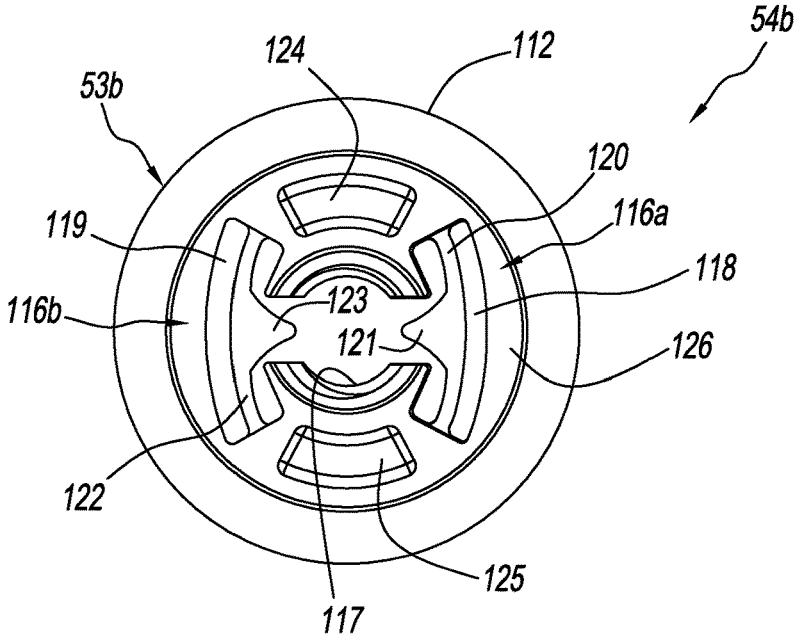
FIG. 15 is a top plan view of the nut of FIG. 14.

Referring to FIGS. 14-15, there is shown an alternate nut, generally designated 54*b*, which may be used with the toilet fastening systems 2, 50. The nut 54*b* generally has the same features, components, functions, and the like as the nuts 54, 54*a* and such features, components, functions, and the like of the nuts 54, 54*a* are thus labeled the same as the nuts 54, 54*a* but with a following "b," "c" or alphabet designation other than an "a." Features, components, functions, and the like of the nut 54*b* that are different from the nut 54 have different numerical labels.

The nut 54*b* has a body 53*b* having a generally hexagonal platform 55*b* that extends axially upwardly from a generally disk shaped base 112, the hexagonal platform having six (6) outwardly facing sides, surfaces, walls, or the like ("walls") 114*a*, 114*b*, 114*c*, 114*d*, 114*e*, 114*f*, (the alphabet nomenclature being arbitrary) each outwardly facing wall 114*a-f* having a respective detent, dimple, hole or the like ("detent") 115*a*, 115*b*, 115*c*, 115*d*, 115*e*, 115*f* (the alphabet nomenclature being arbitrary) for receipt of complementary protrusions on the inside of the cap 56 (or vice versa). The base 112 also provides a seat for the cap 56. The platform 55*b* has a central threaded hole or bore 117 that is sized and configured for reception on the threaded bolt shaft 58.

A first ratchet portion 116*a* is situated about a side of the threaded center 117, while a second ratchet portion 116*b* is situated about another side of the threaded center 117 (the nomenclature first and second being arbitrary), the number of ratchet portions corresponding in number to the number of grooves/channels in the bolt. The first ratchet portion 116*a* includes a cavity 118 in the platform 55*b* that is sized to allow flexing movement of a curved resilient/spring arm 120 which extends between sides of the cavity 118. The curved resilient arm 120 has a pawl 121 that extends radially into the threaded center 117, the pawl 121 defining angled sides, one of the angled sides being the leading side during clockwise rotation of the nut 54*b* and vice versa for counterclockwise rotation. The resilient arm 120 allows the pawl 121 to flex radially in and out relative to the center 117 in order to co-act with the bolt. The second ratchet portion 116*b* includes a cavity 119 in the platform 55*b* that is sized to allow flexing movement of a curved resilient/spring arm 122 which extends between sides of the cavity 119. The curved resilient arm 122 has a pawl 123 that extends radially into the threaded center 117, the pawl 123 defining angled sides, one of the angled sides being the leading side during clockwise rotation of the nut 54*b* and vice versa for counterclockwise rotation. The resilient arm 122 allows the pawl 123 to flex radially in and out relative to the center 117 in order to co-act with the bolt. The first and second pawls 121, 123 provide two locking tabs or pawls 121, 123 89 that are 180 degrees (180°) apart from each other, corresponding to the grooves in the bolt shaft.

The pawls 121, 123 resiliently drop into a groove/channel 64, 66 of the bolt shaft 58 during tightening (rotation in one direction) of the nut 54*b* but resist counter rotation (loosening of the nut 54*b*) due to the stop surface/sides 65, 67. Moreover, the resilient pawls create an audible sound (e.g. clicking or snapping) as the pawls drop into and out of the bolt grooves as well as creating a tactile response or "feel" by the user through the cap 56 as the cap and nut combination advances the nut onto the bolt.

The nut 54*b* is placed onto the top of the threaded shaft 58 and turned a clockwise direction for tightening (right-handed threading, but left-handed threading may be used). As the nut is turned down the shaft the tab protrusions/pawls 121, 123 meet the threading and are deformed radially outwardly. The pawls 121, 123 then turn over the groove/channel shelf and fall into the grooves/channels 64, 66, returning the pawls 121, 123 and spring arms 120, 122 to their original shape/position. The deformation process preferably, but not necessarily create a deformation sound such as clicking or snapping, as well as provide tactile feedback to the user. As the nut 54*b* is turned further down the threaded shaft 58 the pawls 121, 123 rise over the groove exits, deforming the pawls outwardly in a continuous process until rotation is stopped.

Figure 16:
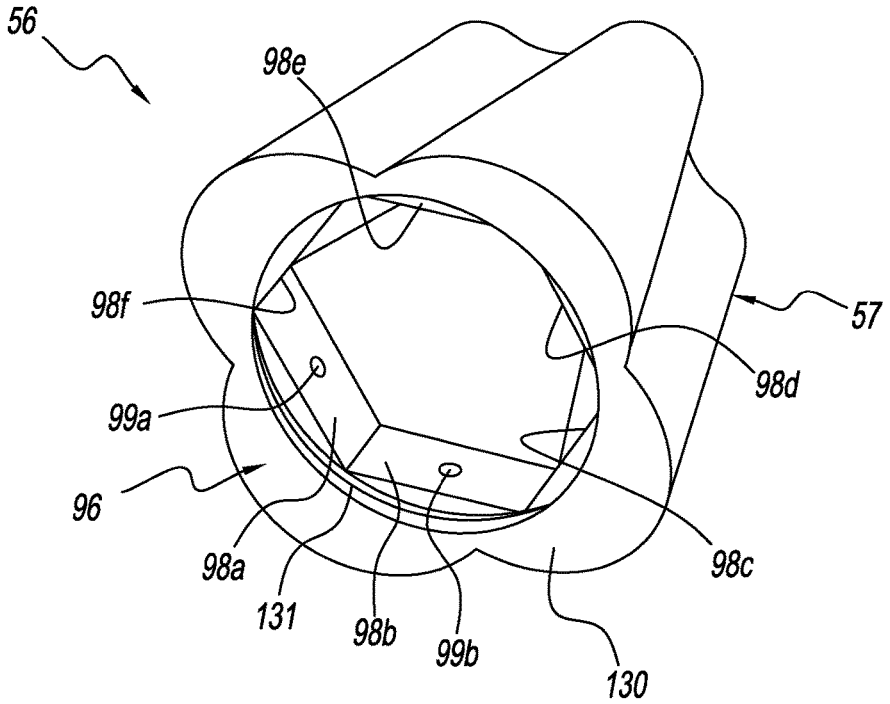
FIG. 16 is an isometric view of a cap for the toilet fastening system of FIG. 5.
Figure 17:
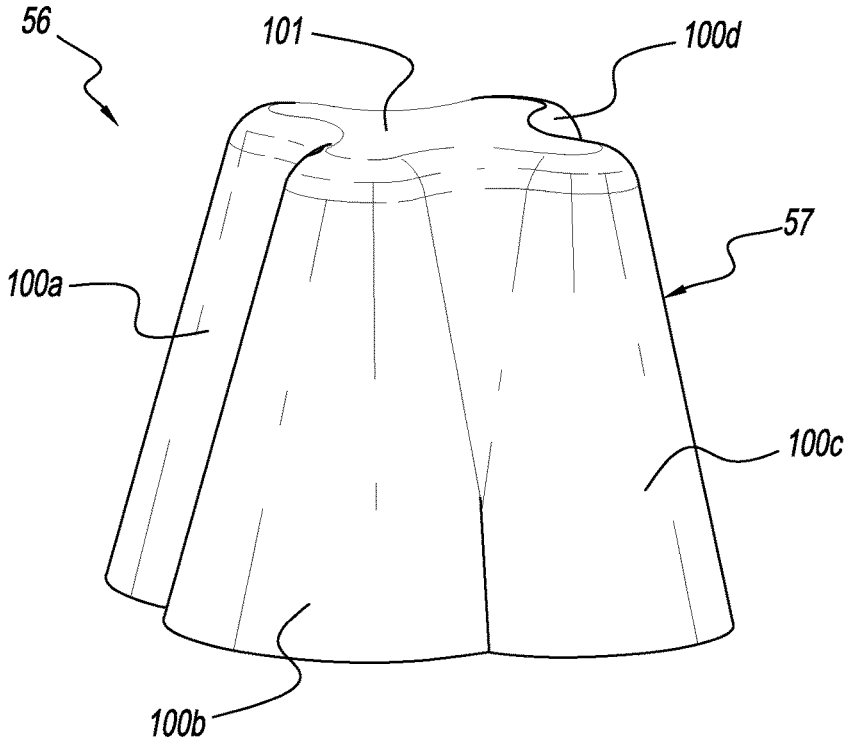
FIG. 17 is another isometric view of the cap.

Referring to FIGS. 16 and 17, the cap 56 is particularly shown. The cap 56 has a body 57 with a generally frusto-conical shape, and which thus extends upwardly from a planar downwardly facing bottom or lower surface 130 in four (4) melded conical shapes 100*a*, 100*b*, 100*c*, 100*d* (the alphabet nomenclature being arbitrary) to an upwardly facing planar top or upper surface 101. The shape of the cap is not limited to a conical shape and can be a dome, cube, cylinder, pyramid or other. The cap 56 defines an interior 96 having a general frusto-conical hexagonal shape with an annular ledge 131 for accepting the base of the nut. The frusto-conical hexagonal interior 96*a* distance equals the height of the hexagonal portion of the nut then narrowing at an angle equal to the pawl assemblies/fins/etc. of the nut. The cavity 96 thus receives the nut and thereafter receives the base of the nut onto the annular ledge 131 of the cap 56, joining the nut and cap into one conjoined part.

It should be appreciated that the present bolt and nut, and/or variations thereof, may be used for applications other than toilet fastening systems. Other observations being that the grooves/channels of the bolt can be used to determine the direction or alignment of the foot in the toilet base flange, and the nut may use flaps, ball and spring assemblies, pins, or the like, the nut tabs, pawls, flanges or the like resiliently snap back for nut removal.

The bolts, nuts, and caps of the present toilet fastening system are composed preferably, but not necessarily, throughout of a non-corrosive, non-metallic material, but multiple types of material may be used. For instance, the material used may be a steel, brass, aluminum, zinc, Polyoxymethylene (POM), Polystyrene (PS), Polyamide, Poly (vinyl chloride), or other metals or plastics. The bolt and nut may include glass or talc in the materials, which increase structural and impact strength and rigidity, or molybdenum sulfide-filled variants which increase lubricity. Examples of commercial polyamide products are Nylon from DuPont, Technyl from Rhodia, Rilsan and Rilsamid from Arkema. The non-metallic material may be polymer based having BHT (butylated hydroxyl-toluene) providing an anti-microbial construction for the bolt, nut and cap. Ceramics may also be used.

The bolt, nut, and cap can be manufactured by the process of injection molding. The bolt can also be manufactured by the process of machining lengths of metal rods and threading by tap and die and then welding the machined foot to the base of the threaded shafts. Injection molding is a process for producing parts by injecting material into an injection mold. Injection molding can be performed with a host of materials, including metals, glasses, elastomers, confections, and most commonly thermoplastic and thermosetting polymers. Material for the part is fed into a heated barrel, mixed, and forced into a mold cavity where it cools and hardens to the configuration of the cavity. Injection molding utilizes a ram or screw-type plunger to force molten plastic material into a mold cavity; this solidifies into a shape that has conformed to the contour of the mold.

Thermoplastics are prevalent due to characteristics which make them highly suitable for injection molding, their ability to soften and flow upon heating high pressure injection of the raw material into a mold which shapes the polymer into the desired shape. Molds can be of a single cavity or multiple cavities.

When thermoplastics are molded, typically pelletized raw material is fed through a hopper into a heated barrel with a reciprocating screw. Upon entrance to the barrel the thermal energy increases and the Van der Waals forces that resist relative flow of individual chains are weakened as a result of increased space between molecules at higher thermal energy states. This reduces its viscosity, which enables the polymer to flow with the driving force of the injection unit. The screw delivers the raw material forward, mixes and homogenizes the thermal and viscous distributions of the polymer, and reduces the required heating time by mechanically shearing the material and adding a significant amount of frictional heating to the polymer. The material feeds forward through a check valve and collects at the front of the screw into a volume known as a shot. Shot is the volume of material which is used to fill the mold cavity, compensate for shrinkage, and provide a cushion the screw to transfer pressure from the screw to the mold cavity. When enough material has gathered, the material is forced at high pressure and velocity into the part forming cavity.

Once the screw reaches the transfer position the packing pressure is applied, which completes mold filling and compensates for thermal shrinkage. The packing pressure is applied until the gate solidifies. Once the gate solidifies, no more material can enter the cavity; the screw reciprocates and acquires material for the next cycle while the material within the mold cools so that it can be ejected and be dimensionally stable. This cooling duration is dramatically reduced by the use of cooling lines circulating water or oil from a thermolator. Once the required temperature has been achieved, the mold opens and an array of pins, sleeves, strippers, etc. are driven forward to demold the article. Then, the mold closes and the process is repeated.

For thermosets, typically two different chemical components are injected into the barrel. These components immediately begin irreversible chemical reactions which eventually crosslinks the material into a single connected network of molecules. As the chemical reaction occurs the two fluid components permanently transform into a viscoelastic solid. After the part has solidified valves close, isolating the injection system and chemical precursors, and the mold opens ejecting the molded parts. Then, the mold closes and the process repeats.

What is claimed is:

1. A toilet fastening system comprising:

a bolt, the bolt having a foot with an upper surface, an inner curved surface on one side of the foot, and an outer curved surface on another side of the foot opposite the inner curved surface, a threaded shaft extending from the upper surface of the foot, a first axial groove in the threaded shaft, the first axial groove having a first ledge defining a first portion of a first ratchet, and a second axial groove in the threaded shaft, the second axial groove having a second ledge defining a first portion of a second ratchet;

a nut, the nut having a base, a threaded bore in the base and sized for threaded reception on the threaded shaft of the bolt, a second portion of the first ratchet situated about a first side of the threaded bore, and a second portion of the second ratchet situated about a second side of the threaded bore; and a cap, the cap having an internal cavity sized for reception on the base of the nut wherein when the cap is received on the base of the nut and the nut is received onto the threaded shaft of the bolt, rotation of the cap rotates the nut relative to the threaded shaft of the bolt whereby rotation of the nut in a direction of rotation that tightens the nut onto the threaded shaft of the bolt causing the first and second ratchets to allow free rotation of the nut in the direction of rotation that tightens the nut onto the threaded shaft, but inhibits rotation of the nut in a direction of loosening the nut from the threaded shaft of the bolt.

2. The toilet fastening system of claim 1, wherein the first and second ratchets create audible feedback during rotation of the nut in the tightening direction.

3. The toilet fastening system of claim 1, wherein the first and second ratchets create tactile feedback during rotation of the nut in the tightening direction.

4. The toilet fastening system of claim 1, wherein the first and second axial grooves are situated 180 degrees apart on the threaded shaft of the bolt.

5. The toilet fastening system of claim 4, wherein the first and second axial grooves each extends the length of the threaded shaft of the bolt.

6. The toilet fastening system of claim 1, wherein the foot has a body with a generally parallelogram shape.

7. The toilet fastening system of claim 1, wherein the cap has a frusto-conical shape.

8. The toilet fastening system of claim 7, wherein the internal cavity of the cap has a frusto-conical shape.

9. The toilet fastening system of claim 1, wherein the internal cavity of the cap includes a seat that receives base of the nut when the cap is joined with the nut.

10. A toilet fastening system comprising:

a bolt, the bolt having a foot with an upper surface, an inner curved surface on one side of the foot, and an outer curved surface on another side of the foot opposite the inner curved surface, a threaded shaft extending from the upper surface of the foot, a first axial groove in the threaded shaft, and a second axial groove in the threaded shaft;

a nut, the nut having a base, a multi-sided platform extending from the base, a threaded bore through the multi-sided platform and base and sized for threaded reception onto the threaded shaft of the bolt, a first pawl situated about a first side of the threaded bore, and a second pawl situated about a second side of the threaded bore; and a cap, the cap having a multi-faced interior cavity configured for reception onto the base of the nut and about the multi-sided platform of the nut, wherein when the cap is received onto the base of the nut and the multi-faced interior cavity of the cap is about the multi-sided platform of the nut and the nut is received onto the threaded shaft of the bolt, rotation of the cap rotates the nut relative to the threaded shaft of the bolt whereby rotation of the nut in a direction of rotation that tightens the nut onto the threaded shaft of the bolt causing the first and second pawls to allow free rotation of the nut in the direction of rotation that tightens the nut onto the threaded shaft, but inhibits rotation of the nut in a direction of loosening the nut from the threaded shaft of the bolt.

11. The toilet fastening system of claim 10, wherein the multi-sided platform comprises a hexagonal platform, and the multi-faced interior cavity comprises a hexagonal interior cavity.

12. The toilet fastening system of claim 10, wherein:

each side of the multi-sided platform has a detent; and each face of the multi-faced interior cavity of the cap has a projection;

each detent receiving a projection when the cap is received onto the nut.

13. The toilet fastening system of claim 10, wherein:

each side of the multi-sided platform has a projection; and each face of the multi-faced interior cavity of the cap has a detent;

each detent receiving a projection when the cap is received onto the nut.

14. The toilet fastening system of claim 10, wherein the first and second pawls create audible feedback during rotation of the nut in the tightening direction.

15. The toilet fastening system of claim 10, wherein the first and second pawls create tactile feedback during rotation of the nut in the tightening direction.

16. The toilet fastening system of claim 10, wherein the first and second axial grooves are situated 180 degrees apart on the threaded shaft of the bolt.

17. The toilet fastening system of claim 10, wherein:

the first pawl comprises a first resilient arm connected to the nut via a first post and having a first free end distal to the first post, and a first projection situated on the first free end; and the second pawl comprises a second resilient arm connected to the nut via a second post and having a second free end distal to the second post, and a second projection situated on the second free end.

18. The toilet fastening system of claim 17, wherein:

the first projection is triangular shaped; and the second projection is triangular shaped.

19. The toilet fastening system of claim 10, wherein the interior cavity of the cap includes a seat that receives base of the nut when the cap is joined with the nut.

20. The toilet fastening system of claim 10, wherein the foot has a body with a generally parallelogram shape.

* * * * *